United States Patent [19]

Storz et al.

[11] Patent Number: 4,583,324

[45] Date of Patent: Apr. 22, 1986

[54] APPARATUS FOR CONTROLLING THE CLOSING SEQUENCE OF DOUBLE LEAVED DOORS

[75] Inventors: Regina Storz, Stuttgart; Fritz Feucht, Renningen; Ralf Storandt, Leonberg, all of Fed. Rep. of Germany

[73] Assignee: GEZE GmbH, Leonberg, Fed. Rep. of Germany

[21] Appl. No.: 627,661

[22] Filed: Jul. 3, 1984

[30] Foreign Application Priority Data

Aug. 16, 1983 [DE] Fed. Rep. of Germany ..... 3329543

[51] Int. Cl.[4] ..... E05C 7/06

[52] U.S. Cl. ..... 49/367

[58] Field of Search ..... 49/366, 367

[56] References Cited

U.S. PATENT DOCUMENTS

| | | | |
|---|---|---|---|
| 1,241,478 | 9/1917 | Nemec . | |
| 1,573,512 | 2/1926 | Bush . | |
| 4,262,448 | 4/1981 | Flider | 49/367 |
| 4,265,051 | 5/1981 | Williams | 49/367 X |

*Primary Examiner*—Kenneth Downey

[57] ABSTRACT

Apparatus is described for regulating the closing sequence of double doors with at least one door closer associated with the leading door and a control arrangement which is actuated by the trailing door and which cooperates with the door closer of the leading door. The special feature of the apparatus lies in the fact that the control arrangement consists of a positioning member, which is arranged in the hinge edge region of the trailing door and is movable by the trailing door between first and second switching positions, and of a connection member which is connected to the positioning member. The connection member extends up to the door closer for the leading door and mechanically transmits the movement of the positioning member, to the closer for the leading door. The leading door end of the connecting member acts on a control member which blocks the closing movement of the door closer in one of the two switching positions of the positioning member.

9 Claims, 10 Drawing Figures

APPARATUS FOR CONTROLLING THE CLOSING SEQUENCE OF DOUBLE LEAVED DOORS

Figure 1:
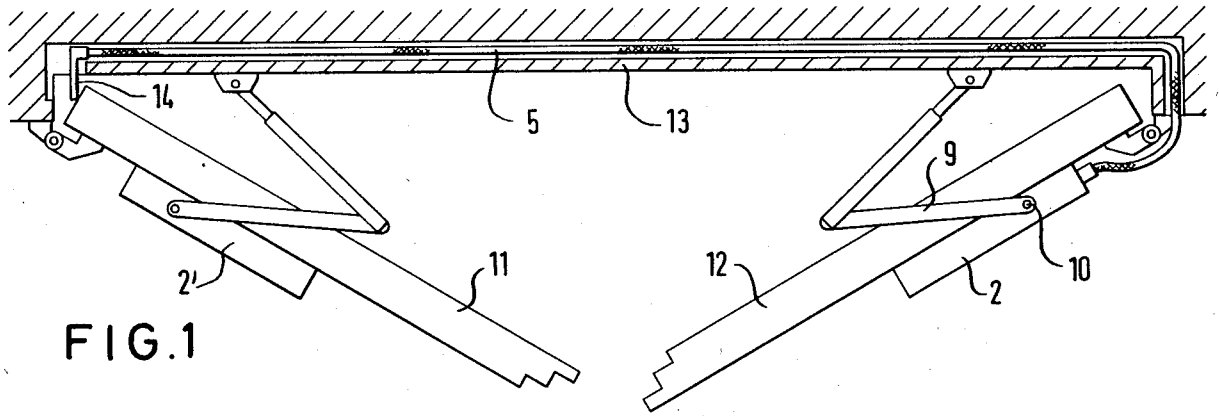

The invention relates to an apparatus for controlling the closing sequence of double doors, the apparatus comprising at least one door closer associated with the leading door and a control arrangement which cooperates with the door closer for the leading door and is actuated via the trailing door.

Apparatus of this kind is known. It has to ensure that the two leaves of a double door (double-leaved door), in which the one door overlaps the other always move into the closed position from any desired opened positions in such a way that the trailing door (i.e. the last door to open) is the first door to reach the closed position, and subsequently that the leading door (i.e. the door which is first to open) then moves into the closed position so that the doors are fully closed in an orderly manner.

A hydraulic arrangement for controlling the closing sequence of double doors is also known in addition to mechanical arrangements. In the hydraulic arrangement the door closers which are associated with the leading door and with the trailing door are connected together via pressure lines which are in particular laid in the door case. The flow paths between the pressure chambers disposed on both sides of the closing piston are controlled in such a way that the door closer associated with the leading door is only released, so that it is able to move the associated door into the closed position, when the door closer associated with the trailing door has at least substantially adopted its closed position.

The principal object underlying the present invention is to provide an apparatus of the initially defined kind which is particularly simple, but nevertheless operationally reliable, and which uses a door closer as a fixing device, to simplify assembly, and to make it easy to match the apparatus without problem to different requirements.

This object is satisfied in accordance with the invention in that the control arrangement consists of a positioning member, which is arranged in the pivot end region of the trailing door and is movable by the trailing door between first and second switching positions, and a connecting member which is connected with the positioning member, which extends up to the door closer for the leading door and which mechanically transmits the movement of the positioning member; and in that the leading door end of the connection member acts on a control member which blocks the closing movement of the door closer in one of the two switching positions of the positioning member.

By using a connection member which mechanically transmits the closing movement and thus the instantaneous position of the trailing door to the closer for the leading door it is possible to achieve, in addition to the advantages which result from satisfying the underlying object, the further advantages that no tampering is necessary in the hydraulic systems of the door closers, and that it is possible to retrofit already mounted door closers with the system of the invention.

The connection member which mechanically transmits the movement of the positioning member is preferably a Bowden cable. It is however also possible, in dependence on the prevailing circumstances of the installation, to use a bar which is rotatably or displaceably journalled in the door case, or a combination of bar and Bowden cable, as the connection member.

If a Bowden cable is used it is preferably connected with the door closer via a threaded nipple and the control member associated with the Bowden cable is preferably biased into the blocking position by means of a spring. In this manner the closing angle of the trailing door at which the leading door is released to execute its closing movement can be conveniently and accurately predetermined by adjusting the relative position of the sleeve and wire of the Bowden cable at the threaded nipple.

An advantageous embodiment of the invention consists of an arrangement in which the control member consists of a latch bolt, with the latch bolt being arranged in a guide housing, being biased by a spring, being connected with the Bowden cable, and cooperating with a cam disk which is rotatably fixedly connected with the axle of the closer and which has an abutment for the latch bolt. In this arrangement the guide housing can preferably be screwed to the closer housing, i.e. the guide housing can be screwed without difficulty to the closer housing in cases in which an existing system is to be retrofitted with the arrangement of the invention.

In addition to the already mentioned advantage of being able to retrofit existing systems this embodiment is of extremely simple construction and offers the significant possibility of being able to provide a practically customary hydraulic door closer with an additional function by means of a few additional parts.

In accordance with a further embodiment of the invention a cam disk is arranged in the connection hinge of the two arms of the closer linkage, with the cam disk having an abutment, being rotatably fixedly connected with the arm of the linkage adjacent the closer, and cooperating with a latch bolt guided in the other arm of the linkage, and with the latch bolt being connected with the Bowden cable, the sleeve of which is braced against the arm.

The main advantage of this embodiment lies in the particularly simple way in which existing systems can be retrofitted with the arrangement, which is restricted to exchanging the linkage, and in the fact that a Bowden cable fixedly mounted to the door case does not pass in a large loop to the closer, which is normally mounted on the door, but can instead run directly from the door case into the linkage.

In accordance with a further embodiment of the invention measures are taken in order to block or release the movement of the closer piston of the door closer associated with the leading door. For this purpose elements are used which operate either directly or indirectly on the piston, with the directly operating elements consisting of a member which acts directly in the path of movement of the piston, and with the indirectly operating elements consisting of a valve member which is arranged in a connection passage between the pressure chambers on the two sides of the piston. All these elements and members are acted on, directly or via appropriate transmission members, by the connection member which mechanically transmits the movement of the positioning member on the trailing door side.

Particularly advantageous developments and variants of the invention are set forth in the subordinate claims.

Figure 2:
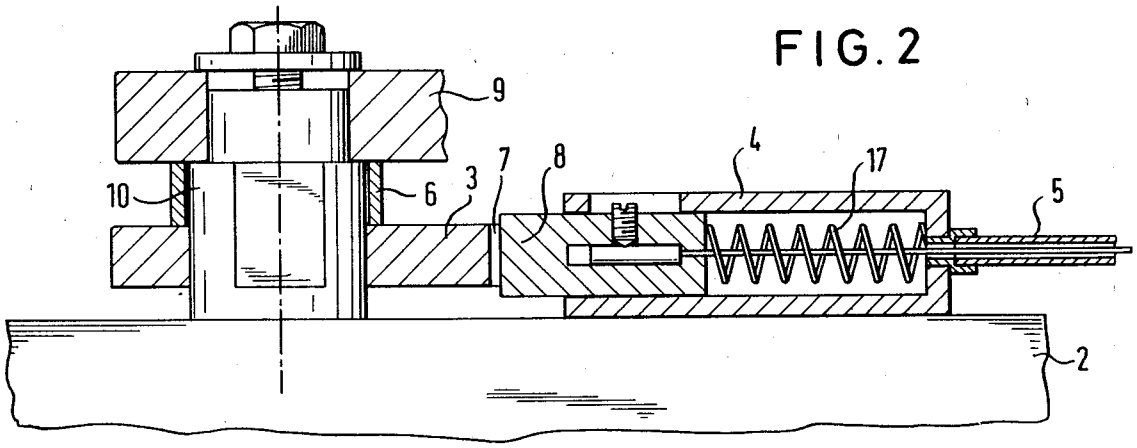
Figure 3:
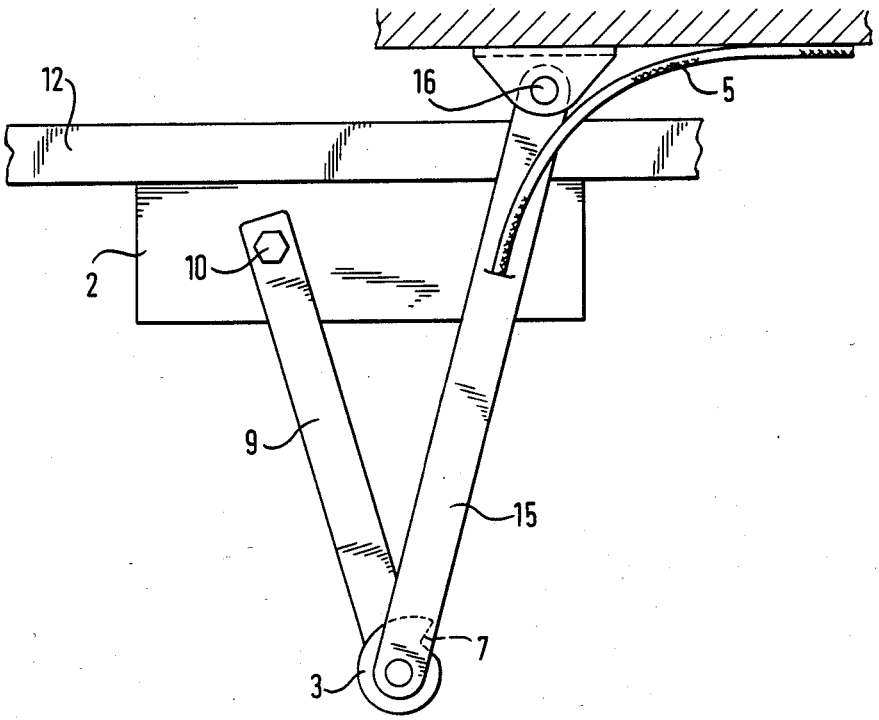
Figure 4:
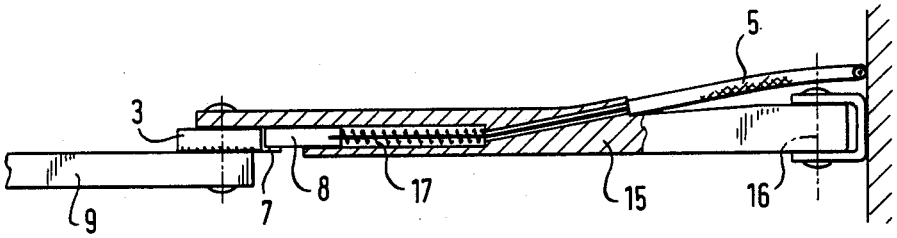
Figure 5:
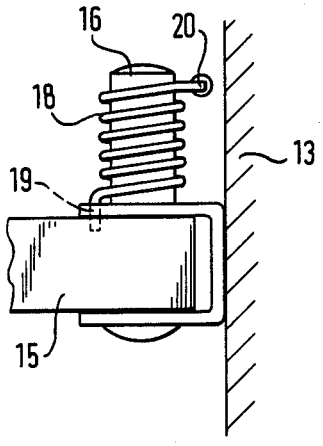
Figure 6:
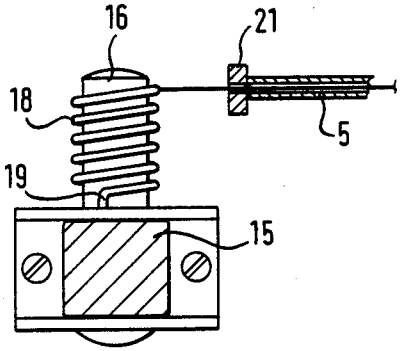
Figure 7:
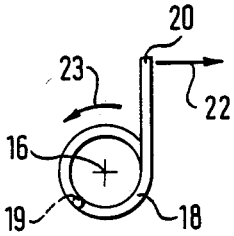
Figure 8:
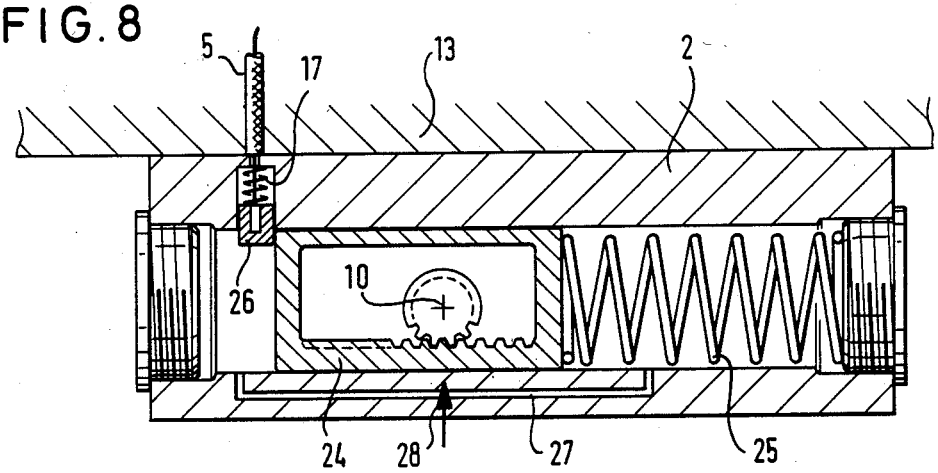
Figure 9:
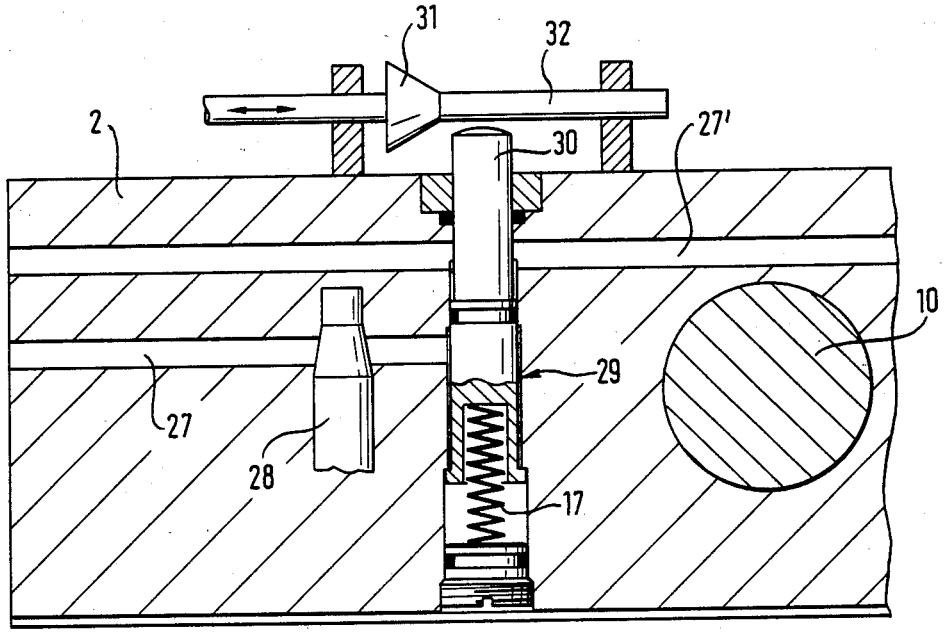
Figure 10:
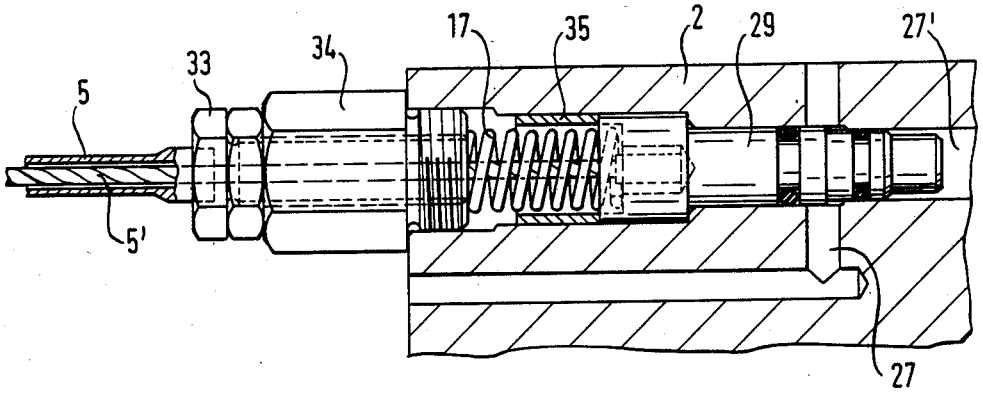

The invention will now be described in the following by referenced to embodiments as shown in the drawing in which:

FIG. 1 is a schematic representation of a double door with an apparatus for controlling the closing sequence, FIG. 2 is a schematic partly sectioned representation of a door closer having a device for controlling the closing sequence, FIG. 3 is a schematic plan view of a linkage extending between a door closer and a door case with an integrated device for controlling the closing sequence, FIG. 4 is a partly sectioned representation for explaining the principle of operation of the apparatus of FIG. 3, FIG. 5 is a schematic partial side view of a linkage arm equipped with a controlled retaining device and secured to the door case, FIG. 6 is a front view of the arrangement of FIG. 5 having a linkage arm which can be seen in section, FIG. 7 is a representation for explaining the principles of operation of the retaining device of FIGS. 5 and 6, FIG. 8 is a schematic partly sectioned representation of a further embodiment of a hydraulic door closer having a controllable blocking device, FIG. 9 is a schematic representation of a further embodiment of a hydraulic door closer having a controllable blocking device, and FIG. 10 is a schematic partly sectioned representation of of the coupling of a Bowden cable to a valve member provided in the housing of the door closer.

The schematic representation of FIG. 1 shows a double door having a trailing door 11 and a leading door 12 which are shown in the partially opened position. Each of the two doors 11, 12 is provided with a door closer 2, 2', with the door closers being disposed at the tops of the respective doors. The axle 10 of each door closer 2, 2' is connected via a linkage 9 with the door case 13.

A positioning member 14 is located in the region through which the side edge of the trailing door 11 adjacent the hinge pivots during opening and closing of the door. The positioning member 14 adopts a first position when the trailing door is in the closed position and a second position when the trailing door 11 is in the opened position. These two positions of the positioning member 14 are transmitted via a mechanical connection member, a Bowden cable arrangement 5 in the illustrated embodiment, to the door closer 2 of the leading door 12 in order to be able to control the closing of the leading door 12 in dependence on the position of the positioning member 14 and thus in dependence on the position of the trailing door 11.

The Bowden cable 5 is guided in the door case 13 and is hardly optically noticable, and in particular not disturbingly so, when the apparatus is mounted.

The arrangement shown in connection with door closers mounted at the top of the doors in FIG. 1 can also be used in principle in similar manner with floor mounted door closers.

FIG. 2 shows a mechanical embodiment of an apparatus for controlling the closing sequence, with a cam disk 3 mounted on the axle 10 of the door closer 2. The curved cam disk is secured against rotation relative to the axle 10 by an appropriate flat on the axle and an aperture of complementary shape in the cam disk 3. The cam disk 3 is retained by a distance sleeve 6 which extends between the cam disk 3 and an arm 9 of the linkage, via the bolt which serves to secure the linkage.

A latch mechanism cooperates with the cam disk 3. The latch mechanism consists of a latch bolt 8 which is displaceably journalled in a guide housing 4 and which is spring biased by compression spring 17 and connected to the Bowden cable 5. The guide housing 4 is preferably screwed to the upper side of the housing 2 of the door closer.

The latch bolt 8 engages with the cam disk 3 and cooperates with an abutment 7 thereon, with this abutment 7 being designed so that it is adequately stable and shaped so that the decoupling of the abutment 7 and the latch bolt 8 can be achieved with comparatively low forces. The surfaces of the abutment 7 and of the latch bolt 8 which engage with one another preferably extend obliquely to the axis of the latch bolt.

The apparatus operates as follows:

When the trailing door is opened the Bowden cable is relieved, i.e. the latch bolt 8 acts on the cam disk 3. When the trailing door is closed the Bowden cable is drawn, i.e. the latch bolt 8 is withdrawn into the guide housing 4 against the bias force of the spring 7.

If both doors, i.e. the trailing door and the leading door are opened then these two doors will close again quite normally if they are not secured. It is only at a specific angle which is defined by the cam disk 3, i.e. by the position of the abutment 7 of the cam disk, that the leading door will be blocked, because the latch bolt 8 has come into engagement with the abutment 7 and blocks the further closing movement of the leading door. If the trailing door moves into the closed position then this leads to withdrawal of the Bowden cable 5, so that the latch bolt 8 and the abutment 7 are decoupled, and the leading door is freed to return to its closed position.

The angle at which the leading door is held, which is defined by the position of the abutment 7 on the cam disk 3 must be selected so that the trailing door can move past the leading door while the latter is blocked. This is possible within an opening angle of the leading door in the range from approximately 20° to 40° and the angle determined by the position of the abutment 7 is also selected to lie in this range.

FIG. 3 shows a variant with a blocking device integrated into the closer linkage, which is particularly suitable for retrorespectively equipping existing door closer systems with the arrangement of the invention, because in practice the retrofitting can be effected by exchanging only the linkage 9, 15.

In this arrangement the cam disk 3 is rotatably fixedly connected to the closer arm 9 which is attached to the axle 10 of the door closer 2. The latch device associated with the cam disk 3 is housed in the linkage arm 15 into which the Bowden cable 5 is inserted. The linkage arm is connected with the door case at a pivot pin 16 whereas the closer 2 is secured to the leading door 12.

FIG. 4 shows the arrangement of FIG. 3 in the sectioned and opened up state. It can be seen that the sleeve of the Bowden cable 5 is braced at the point of entry of the Bowden cable into the closer arm 15 against the wall of the closer arm, and that the Bowden cable itself is connected with the latch bolt 8, which is displaceably guided in an appropriate recess of the arm 15 and biased in the direction towards the cam disk 3 by means of a compression coil spring 17.

In addition to the previously mentioned advantage of suitability for retro-equipping, the solution of FIGS. 3 and 4 is in practice advantageous because the Bowden cable, which is fixedly laid on the door case, does not have to pass around a large loop to the closer 2, which is normally mounted on the door, but instead the Bowden cable can run directly from the door case into the linkage, i.e. into the closer arm 15. As the arm 15 moves relative to the wall less than the door closer 2 mounted on the door 12 the Bowden cable 5 is less stressed, and its ease of movement is not impaired.

FIGS. 5 to 7 show a variant with a stepless retention of the leading door 12, which is achieved by using a wrap spring 18 which cooperates with a pivot pin 16 which is rotatably fixedly connected with the arm 15 of the linkage in the manner of a wrap spring free-wheel coupling. One end 19 of this spring 18 is connected with the bearing sleeve for the linkage arm 15 which is connected with the door case 13, whereas the Bowden cable acts on the other end 20 of the spring 18 with the sleeve of the Bowden cable being fixedly braced relative to the door case. The bracing of the Bowden cable on the door case can be seen at 21 in FIG. 6.

The principle of operation of this stepless retaining device is illustrated in FIG. 7. If the end 20 of the spring 18 is drawn by means of the Bowden cable 5 in the direction of the arrow 22 then the pin 16, and thus the linkage arm 15, can rotate or pivot freely. If the Bowden cable 5 is relieved then the pivot pin 16 becomes clamped in the spring 18 on rotation in the direction of the arrow 23, and is retained via the lower end 19 of the spring 18 which is secured to the bearing sleeve.

In the embodiment of the invention shown in FIG. 8 the door closer is mechanically blocked by a blocking member 26 at an angle of opening of the leading door which is preferably selected to lie between 20° and 40° relative to the door case. The blocking member 26 prevents the movement of the piston 24 in the door closer 2. The blocking member 26 is acted on by a compression spring 17 which biases the blocking member 26 in such a way that it projects into the pressure space to the left of the piston 24 when the Bowden cable 5 is relaxed and forms a stop for the piston 24. If the Bowden cable 5 is actuated or drawn then this results in retraction of the member 26 from the pressure space, and the piston 24 can move in the direction of closure, which results in closing of the door closer. The speed of closing can be adjusted via a valve 28 which is arranged in the connection passage 27 between the chambers on the two sides of the piston 24. The piston 24 is normally biased in the usual manner in the closing direction by a closing spring 25.

The embodiment of FIG. 8 is particularly suitable for use in situations in which the closer is mounted on the door case 13 and not on the door. The laying of the Bowden cable 5 is in this case possible in a particularly simple manner.

In accordance with a variant which is not illustrated in the drawing the blocking member 26 can also be operated via a push rod from a cam disk which is arranged on a rod which is rotatable in dependence on the movement of the trailing door, or can be changed over between two pivotal positions in dependence on the respective position of the trailing door. The pivoting of the cam disk then controls the blocking member 26 in corresponding manner to that described in connection with FIG. 8.

In the embodiment of FIG. 9 the movement of the closer piston is controlled in dependence on the respective position of the positioning member associated with the trailing door by a valve 29 which is arranged in the flow channel 27, 27' between the two pressure chambers of the door closer and which can be switched over via rigid or flexible operating elements between the closed and opened positions. In the closed position the valve prevents any form of oil loss between the two pressure chambers and thus any movement of the piston. The valve 29 is biased towards the closed position via a pressure spring 17. A movement of the closer piston is thus not possible. If the valve 29 is actuated via the push rod 30 which projects beyond the closer housing 2, then the blocked passage is first opened and the doors can move into the closed position. The displacement of the push rod 30 against the force of the spring 17 takes place via a cone 31 which is attached to a rod 32 displaceable relative to the door closer 2. The linear displacement of this rod 32 again takes place in dependence on the positioning member 14 shown in FIG. 1.

A further valve 28 is arranged directly adjacent the valve 29 in the channel 27 and makes it possible to change the flow resistance in this passage and thus to regulate the speed of closing.

The control of a valve 29 housed in the door closer 2 via a Bowden cable 5, 5' is illustrated in FIG. 10. In this arrangement the sleeve 5 of the Bowden cable is braced against a positioning screw 33 of a threaded head 34 which can be threaded into a corresponding threaded bore of the housing 2. The adjustment of the Bowden cable can take place by means of the positioning screw 33. The valve 29 is biased by the spring 17 into the closed position in which the passage of oil between the passage sections 27 and 27' is prevented and thus movement of the closer piston is blocked. The valve body is displaced to the left by actuating the Bowden cable and indeed by a maximum stroke which is restricted by the distance sleeve 35. In this way the passage section 27 is connected with the passage section 27' and the oil can flow unhindered through the passage via a subsequent regulating valve. In this way the leading door can close in a damped manner. This embodiment is characterized by the fact that it can be readily integrated into a door closer, by its compactness and by its simple adjustability.

Whereas the mechanical embodiments of the invention are characterised by their particularly simple construction, by the fact that they can easily be used to retrofit existing installations, and by the fact that no creeping of the door closer can occur due to minor leakage of the hydraulic system when the closer is fixed in a particular position, i.e. slow closing movement of the respective door can be reliably prevented, the embodiments with a valve integrated into the closer and a blocking member have the additional advantages that the compact constructional arrangement of the closer housing is maintained, that no complicated assembly is required at the point of installation when setting up the double leaved doors, in particular fire protection doors, because the closing sequence regulator is already integrated into the door closer, and that contamination of the control member of the control valve is made more difficult because of the integrated construction which leads to an overall arrangement which is particularly service-friendly.

We claim:

1. Apparatus for controlling the closing sequence of double doors, the apparatus comprising at least one door closer associated with the leading door and a control arrangement which cooperates with the door closer for the leading door and is actuated via the trailing door, characterized in that the control arrangement consists of a positioning member (14), which is arranged in the pivot end region of the trailing door (11) and is movable by the trailing door between first and second switching positions, and of at least in part of a Bowden cable (5,5') which is connected with the positioning member (14), which extends up to the door closer (2) for the leading door (12) and which mechanically transmits the movement of the positioning member; and in that the leading door end of the Bowden cable (5,5') acts on a control member (3; 18; 16; 26; 29, 30) which blocks the closing movement of the door closer (2) in one of the two switching positions of the positioning member (14); there being provided a control member (8; 18; 29) associated with the Bowden cable (5,5') which is biased into the blocking position by means of a spring.

2. Apparatus in accordance with claim 1, characterised in that the leading door end of the connection member which mechanically transmits the movement of the positioning member is provided with an eccentric element or a cone (31) for actuating a push rod (30) which directly or indirectly blocks the movement of the closer.

3. Apparatus in accordance with claim 1, characterised in that a cam disk (3) is arranged, in the connection hinge of the two arms (9, 15) of the closer linkage, with the cam disk (3) having an abutment (7), being rotatably fixedly connected with the cam (9) of the linkage adjacent the closer, and cooperating with a latch bolt (8) guided in the other arm (15) of the linkage, and with the latch bolt (8) being biased by a spring (17) and being connected with the Bowden cable (5), the sleeve of which is braced against the arm (15).

4. Apparatus in accordance with claim 1, characterised in that a wrap spring (18) is arranged on a pivot pin (16) which is rotatably fixedly connected with one arm (15) of the closer and supported in a bearing at the door case end, with one end (19) of the wrap spring (18) being connected with the bearing, and with the other end (20) of the wrap spring being connected with the Bowden cable (5), the sleeve of which is braced at the door case end, and being energisable in the sense of winding up the wrap spring (18).

5. Apparatus in accordance with claim 1, characterised in that a door closer (2) which is in particular to be mounted on the door case, has a bore which opens into the piston guiding chamber, with a blocking member (26) being provided in this bore and being movable via the mechanical connection member, in particular via the Bowden cable (5, 5') into the path of movement of the piston (24) to block it in dependence on the positioning member (14).

6. Apparatus in accordance with claim 1, characterised in that a blocking valve (29) is provided in a bore (27, 27') which connects the chambers provided on the two sides of the closer piston (24), in particular directly adjacent to a valve (28) provided in the bore (27) for adjusting the damping of the door closer; and in that the blocking valve is actuatable either via a push rod (30) which projects beyond the housing of the closer, or directly via the cable (5') of the Bowden cable (5) which is attached to the closer housing via a threaded nipple (34).

7. Apparatus in accordance with claim 1, characterised in that the control member consists of a latch bolt (8), with the latch bolt (8) being arranged in a guide housing (4), being biased by a spring (17), being connected with the Bowden cable (5, 5'), and cooperating with a blocking member (3, 36) secured to the axle (10) of the closer.

8. Apparatus in accordance with claim 7, characterised in that the blocking member comprises a cam disk (3) having an abutment (7).

9. Apparatus for controlling the closing sequence of a pair of double doors consisting of a leading door and a trailing door; the apparatus comprising a first door closer associated with said leading door, a second door closer associated with said trailing door, and a control arrangement which cooperates with said first door closer and is actuated in dependence on the movement of said trailing door, wherein said control arrangement comprises a positioning member movable in response to movements of said trailing door between first and second switching positions, and a connecting member consisting at least in part of a Bowden cable, which is connected with said positioning member, which extends up to said first door closer, and which mechanically transmits the movement of said positioning member; and wherein the leading door end of said Bowden cable acts on a control member movable via said Bowden cable in response to movement of said positioning member, with said control member blocking the closing movement of said first door closer when said positioning member is in said first switching position, but permitting said closing movement of said first door closer when said positioning member is in said second switching position.

* * * * *